US009295608B2

(12) United States Patent
Ma et al.

(10) Patent No.: US 9,295,608 B2
(45) Date of Patent: Mar. 29, 2016

(54) NECK MASSAGER

(75) Inventors: Xuejun Ma, Shenzhen (CN); Xuliang Wu, Shenzhen (CN); Jun Zhao, Shenzhen (CN)

(73) Assignee: Shenzhen Breo Technology Co., Ltd., Shenzhen (CN)

( * ) Notice: Subject to any disclaimer, the term of this patent is extended or adjusted under 35 U.S.C. 154(b) by 810 days.

(21) Appl. No.: 13/515,485

(22) PCT Filed: Feb. 22, 2012

(86) PCT No.: PCT/CN2012/071454

§ 371 (c)(1), (2), (4) Date: Jun. 12, 2012

(87) PCT Pub. No.: WO2013/107073

PCT Pub. Date: Jul. 25, 2013

(65) Prior Publication Data

US 2013/0184621 A1 Jul. 18, 2013

(30) Foreign Application Priority Data

Jan. 18, 2012 (CN) ..... 2012 1 0015797

(51) Int. Cl.
*A61H 7/00* (2006.01)
*A61H 19/00* (2006.01)

(52) U.S. Cl.
CPC ..... *A61H 7/004* (2013.01); *A61H 2201/0192* (2013.01); *A61H 2201/1215* (2013.01); *A61H 2201/1463* (2013.01);
(Continued)

(58) Field of Classification Search
CPC ..... A61H 7/00; A61H 7/001; A61H 7/002; A61H 7/004; A61H 7/007; A61H 11/00; A61H 23/00; A61H 23/006; A61H 23/02; A61H 23/0254
USPC ..... 601/107–114, 134–137
See application file for complete search history.

(56) References Cited

U.S. PATENT DOCUMENTS 1,747,371 A * 2/1930 Luehrmann et al. ..... 601/143
5,695,451 A * 12/1997 Kawakami ..... 601/84
8,079,969 B2 * 12/2011 Rousso et al. ..... 601/148
(Continued)

FOREIGN PATENT DOCUMENTS

CN 1228299 9/1999
CN 201108569 9/2008
(Continued)

*Primary Examiner* — Justine Yu
*Assistant Examiner* — Kathrynn Lyddane
(74) *Attorney, Agent, or Firm* — Hamre, Schumann, Mueller & Larson, P.C.

(57) ABSTRACT

The present invention relates to a health massage apparatus, providing a neck massager including a U-shaped neck pillow capable of being hungon a neck of a person, an inside of the U-shaped neck pillow corresponding to the neck has at least one massage component, the at least one massage component include at least two massage heads from the top down along the inside of the U-shaped neck pillow, a height of the upper massage head is lower than the adjacent lower massage head in sequence. According to the human neck characteristics involving the protrusion of the upper neck and the depression of the lower neck, in the present invention the upper massage head is set a low position and the lower massage head is set at a high position, advantageously, each of the massage heads respectively massages the corresponding neck part, the good massage effect can be obtained.

6 Claims, 8 Drawing Sheets

(52) U.S. Cl.
CPC ..... *A61H 2201/1609* (2013.01); *A61H 2201/1671* (2013.01); *A61H 2205/04* (2013.01)

(56) References Cited

U.S. PATENT DOCUMENTS

| | | | | |
|---|---|---|---|---|
| 2006/0069331 | A1 | 3/2006 | Huang | |
| 2006/0142675 | A1* | 6/2006 | Sargent | 601/70 |
| 2007/0106185 | A1* | 5/2007 | Ferber et al. | 601/86 |
| 2009/0118652 | A1* | 5/2009 | Carlucci | 601/134 |
| 2011/0265254 | A1* | 11/2011 | Ma et al. | 2/420 |

FOREIGN PATENT DOCUMENTS

| | | |
|---|---|---|
| CN | 201182728 | 1/2009 |
| CN | 201768136 | 3/2011 |
| CN | 201775757 | 3/2011 |

* cited by examiner

NECK MASSAGER

BACKGROUND OF THE INVENTION

1. Technical Field

The present invention relates to a health massage apparatus, and more particularly, to a neck massager.

2. Description of Related Art

In recent years, with the development of the society, the pace of persons' work and living becomes fast, the working pressure becomes great and the rest time becomes less. With the passage of time a person will be physically and mentally exhausted, particularly, for the crowd that works for a long time every day, their cervical vertebrae keeps a special state for a long time and neck muscles suffer from incompatible forces, as a result, their neck hind muscles and ligament strain is easy to suffer from stretching strain. Additionally, the torsion, the lateroflexion of the neck and so on are easy to bring about cervical spondylosis.

Therefore, all kinds of massagers used for massaging the neck and shoulder are provided, however, the massaging pattern of those massagers is too single, they can't provide different parts of necks with personalized massages and have the poor massage effect.

BRIEF SUMMARY OF THE INVENTION

A technical problem to be solved by the present invention is to overcome the shortcomings of the prior art and provides a neck massager having a simple structure and good massage effect which is convenient for use.

The present invention adopts the following technical solutions to solve the technical problems: providing a neck massager including a U-shaped neck pillow capable of being hunging on a neck of a person, an inside of the U-shaped neck pillow corresponding to the human neck has at least one massage component including at least two massage heads from the top down along the inside of the U-shaped neck pillow, a height of the upper massage head is lower than the adjacent lower massage head in sequence.

Further, two massage components are provided and an adjusting means capable of adjusting the distance between the two massage components is provided.

In particular, each the massage component includes two massage heads, a driving means used for driving the two massage heads and a transmission mechanism mounted between the driving means and the two massage heads, the transmission mechanism is located in a shell, the outside of the shell is provided with the two massage heads which protrude towards the inside of the U-shaped neck pillow.

In particular, the transmission mechanism includes a driving gear, a first follower gear driving by the driving gear and two second follower gears driving by the first follower gear and respectively used for driving the two massage heads, the driving means has a power element whose output shaft extends into the shell, the driving gear is fixed on the output shaft.

Further, a third follower gear is provided between the first follower gear and the two second follower gears, both of the first follower gear and third follower gear are dual gear having an upper gear ring and a lower gear ring, the upper gear ring of the first follower gear engages with the lower gear ring of the third follower gear, the lower gear ring of the first follower gear engages with the driving gear, the upper gear ring of the third follower gear respectively engages with the two second follower gear.

Furthermore, the driving means further includes a control PCB connected with the power element, the control PCB is connected with the batteries in the U-shaped neck pillow.

In particular, the adjusting means includes a rotating shaft extending into the U-shaped neck pillow from the external part thereof, a knob mounted on an external end of the rotating shaft, a gear mounted on the internal end of the rotating shaft and two racks respectively engaging with the upper and lower of the gear, the two racks are respectively connected to the two massage components correspondingly.

In particular, the adjusting means further has a bidirectional locking structure between the knob and the rotating shaft.

In particular, the locking structure includes a ratchet wheel clasp which is able to synchronous rotate with the knob and a ratchet wheel base which is able to engage with the ratchet wheel clasp, the rotating shaft is fixed in a center of the ratchet wheel clasp.

In particular, the ratchet wheel clasp has an upper ratchet buckle and a lower ratchet buckle mounted against each other, the ratchet wheel base is provided with an upper ratchet ring and a lower ratchet ring, the ratchet directions of the upper ratchet ring and the lower ratchet ring are in an opposite direction, the ratchet buckle and the lower ratchet buckle respectively matches with the upper ratchet ring and lower ratchet ring.

According to the human neck characteristics involving the protrusion of the upper neck and the depression of the lower neck, in the present invention the upper massage head is set low and the lower massage head is set high, advantageously, each of the massage heads respectively massages the corresponding neck part, the good massage effect can be obtained.

DETAILED DESCRIPTION OF THE INVENTION

In order to make clearer the objects, technical solutions and advantages of the invention, the present invention will be explained below in detail with reference to the accompanying drawings and embodiments. It is to be understood that the following description of the embodiments is merely to explain the present invention and is no way intended to limit the invention.

A technical problem to be solved by the present invention is to overcome the following shortcomings of the prior art: the structure of the neck massager is single and has poor effect of massage. The present invention provides a neck massager, including a U-shaped neck pillow capable of hanging on human neck, the inside of the U-shaped neck pillow corresponding to the human neck has at least one massage component including at least two massage heads from the upper to the lower along the inside of the U-shaped neck pillow, the height of the upper massage head is lower than the adjacent lower massage head in sequence. According to the human neck characteristics involving the protrusion of the upper neck and the depression of the lower neck, in the present invention the upper massage head is set low and the lower massage head is set high, advantageously, each of the massage heads respectively massages the corresponding neck part, the good massage effect can be obtained.

Referring to the accompanying figures, the following further details embodiments of the present invention.

Figure 1:
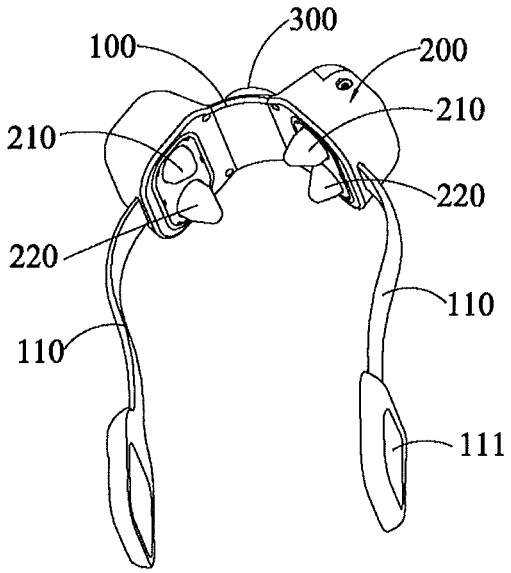
FIG. 1 is a schematic structure view of a neck massager of an embodiment in accordance with the present invention.
Figure 2:
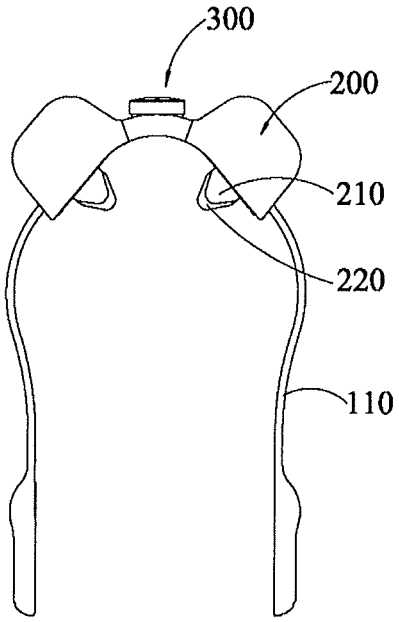
FIG. 2 is a schematic structure view of the neck massager of the embodiment viewed from another angle.
Figure 3:
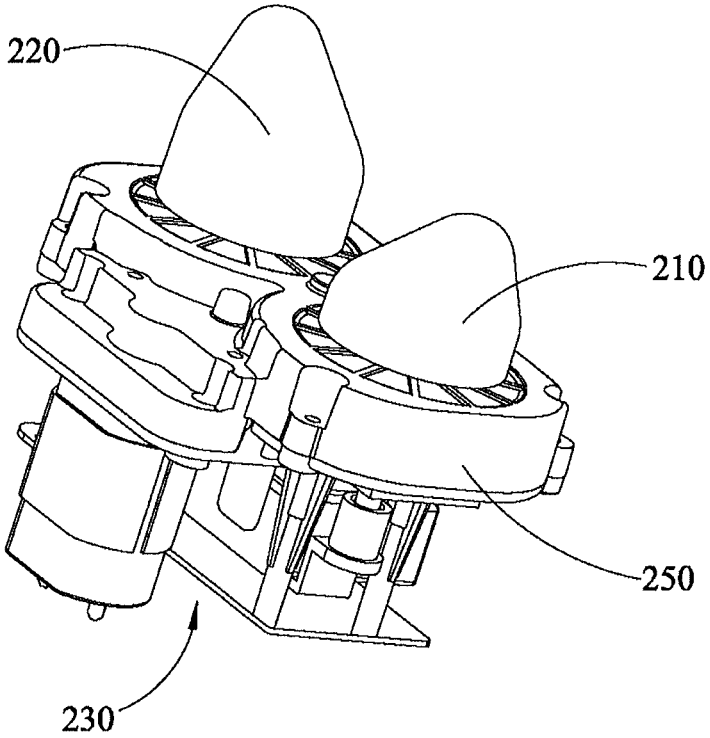
FIG. 3 is a schematic structure view of a massage component of the embodiment.

Referring to FIG. 1 and FIG. 2, an embodiment of the present massager provides a neck massager, including a U-shaped neck pillow 100 for being hung on a neck of a person, the inside of the U-shaped neck pillow 100 corresponding to the neck has two massage components 200, each of the two massage components 200 includes two massage heads from the upper to the lower along the inside of the U-shaped neck pillow 100, namely an upper massage head 210 and a lower massage head 220, the height of the upper massage head 210 is lower than the adjacent lower massage head 220, in this way, the optimal match between the two massage heads and the neck can be obtained, of course, a plurality of massage heads can be provided from the upper to the lower along the inside of the U-shaped neck pillow 100.

In this embodiment, two massage components 200 are symmetrically provided, the massage using the components has the effect that is similar to the kneading of two fingers of the hand, an adjusting means 300 is provided between two massage components 200, by setting the adjusting means 300 to adjust the distance between two massage components, the neck massager can be suitable for different persons, based on the size of the neck of the person, the massage components 200 can be adjusted in order to make the massage components 200 match with the corresponding neck part and obtain good massage effect.

Referring to FIG. 3 to FIG. 6, in this embodiment each of the massage components 200 includes an upper massage head 210, a lower massage head 220, a driving means 230 used for driving the two massage heads and a transmission mechanism 240 mounted between the driving means 230 and the two massage heads, wherein the transmission mechanism 240 is located in a shell 250, the outside of the shell 250 is provided with an upper massage head 210 and a lower massage head 220 which protrude to the inside of the U-shaped neck pillow 100.

Figure 4:
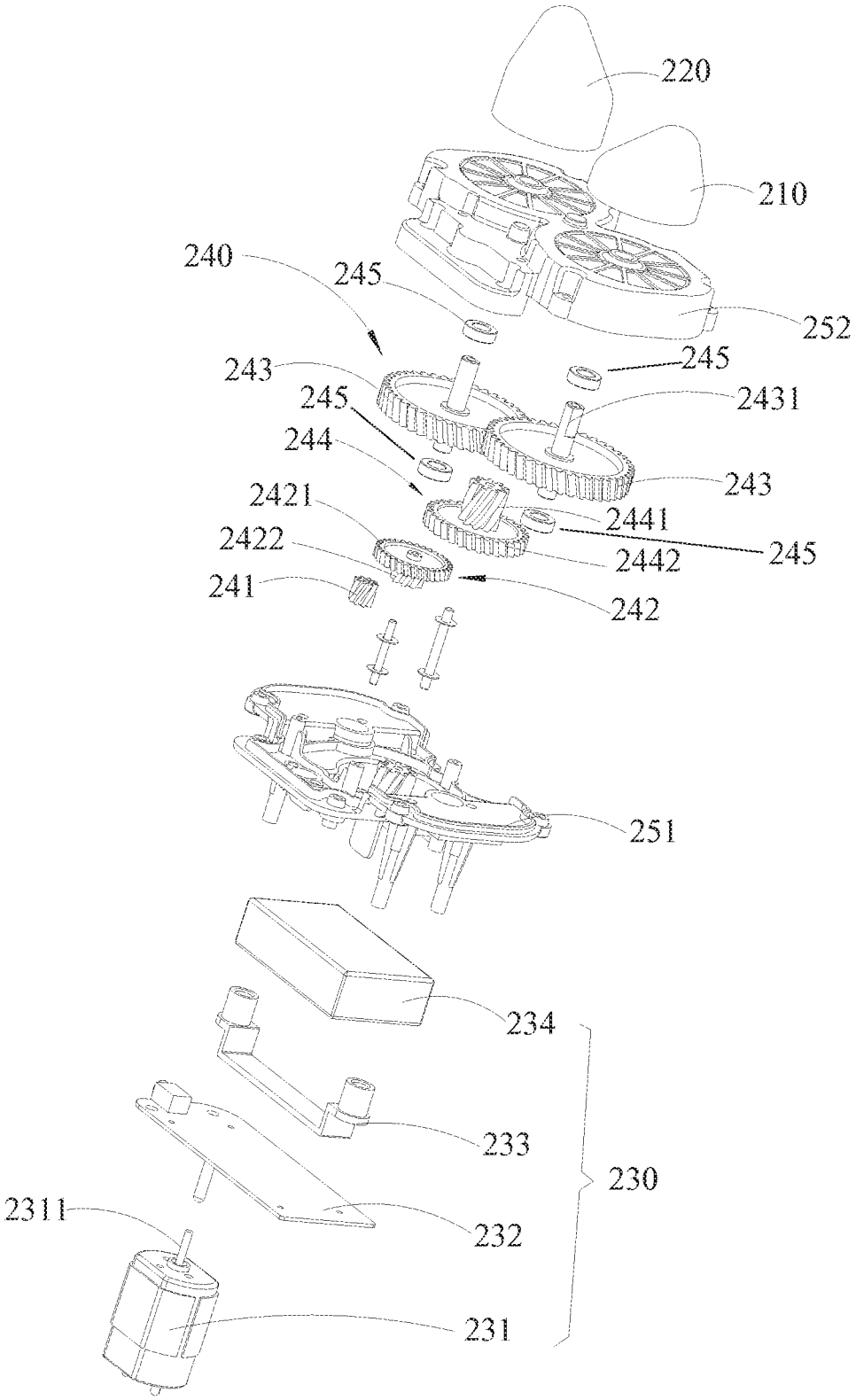
FIG. 4 is an exploded view of FIG. 3.
Figure 5:
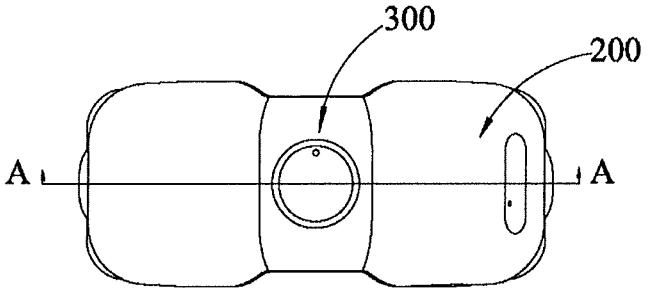
FIG. 5 is a top view of the neck massager of the embodiment.
Figure 6:
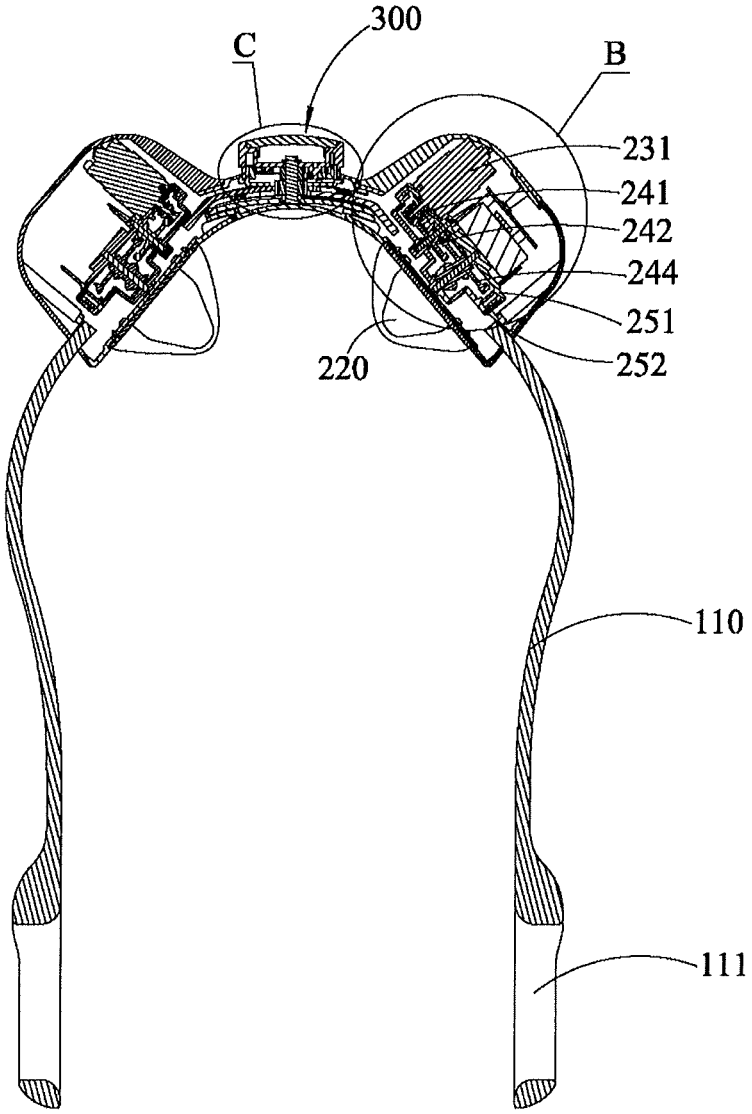
FIG. 6 is a schematic sectional view from a line A-A.

In particular, referring to FIG. 4 and FIG. 6, the transmission mechanism 240 includes a driving gear 241, a first follower gear 242 driven by the driving gear 241 and two second follower gears 243 driven by the first follower gear 242, the upper massage head 210 and the lower massage head 220 are respectively fixed on the center shaft 2431 of the two second follower gears 243, the driving means 230 has a power element 231, the shell 250 includes a first shell 251 and a second shell 252, the output shaft 2311 of the power element 231 extends into the first shell 251 and the driving gear 241 is fixed on the extending end of the output shaft 2311. Two bearings 245 are arranged above and below each of the two second follower gears 243 and used for reducing the friction coefficient of the second follower gears 243 during the rotation thereof.

Figure 7:
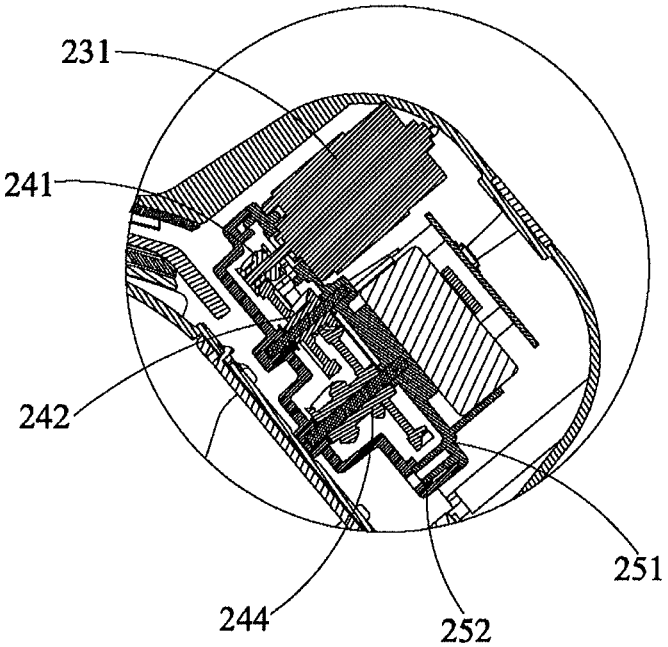
FIG. 7 is an enlarged view of a part labeled by B in FIG. 6.
Figure 8:
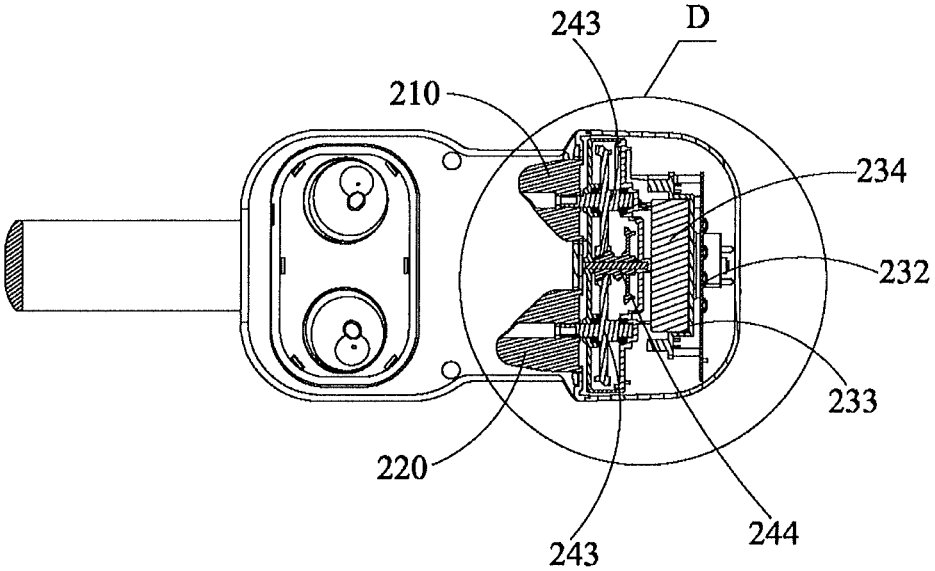
FIG. 8 is a partial sectional view of the neck massager of the embodiment.
Figure 9:
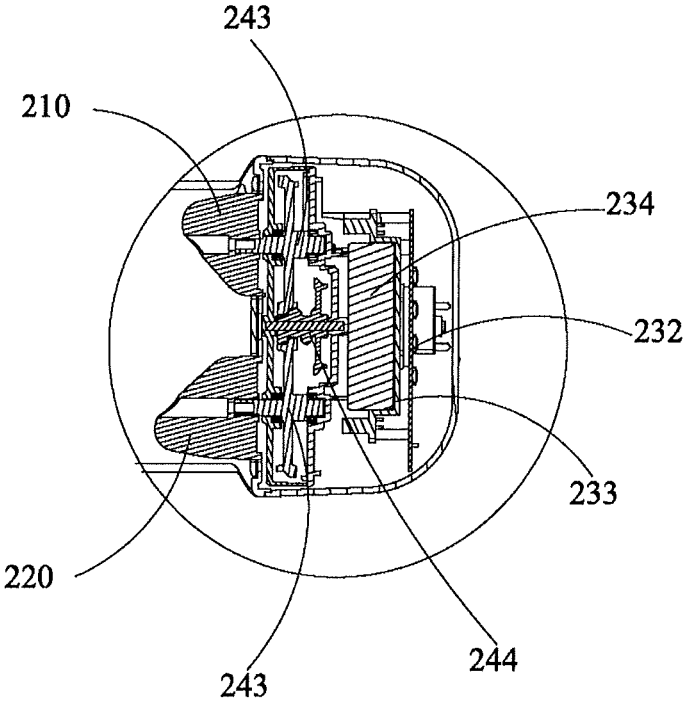
FIG. 9 is an enlarged view of a part labeled by D in FIG. 8.

Further, referring to FIG. 7 to FIG. 9, in this embodiment a third follower gear 244 is provided between the first follower gear 242 and the two second follower gears 243, both of the first follower gear 242 and third follower gear 243 are duplicate gears having an upper gear ring and a lower gear ring, the driving gear 241 and the second follower gears 243 are gear mechanism, the upper gear ring 2421 of the first follower gear 242 engages with the lower gear ring 2442 of the third follower gear 244, the lower gear ring 2422 of the first follower gear 242 engages with the driving gear 241, the upper gear ring 2441 of the third follower gear 244 respectively engages with the two second follower gears 243. In this embodiment, after the power element 231 is started, the driving gear 241 is driven to rotate, the first follower gear 242 is driven to rotate by the driving gear 241, the third follower gear 244 is also driven to rotate by the first follower gear 241, the two second follower gears 243 are also driven to rotate by the third follower gear 244, finally, the upper massage head 210 and the lower massage head 220 are driven to rotate in order to massage the neck. In this embodiment, a multiple-stage driving mechanism is used which has the following benefits: on the one hand, the good stability of gears can be got, on the other hand, the speed of the second follower gear 243 can be reduced to an appropriate level for the setting of the appropriate drive ratio as the deceleration function, additionally, the multiple-stage driving mechanism is more compact in order to obtain the same rotate speed.

In this embodiment, the driving means 230 further includes a control PCB (Printed Circuit Board) 232 connected with the power element 231, in the U-shaped neck pillow 100 a lithium battery 234 is installed fixedly by a press block 233 outside of the shell 250, the lithium battery 234 is connected with the control PCB 232, the lithium battery 234 provides the neck massager with a inner spare battery. Generally, the neck massager is connected with an external power by a connector plug (not shown), the spare battery is convenient for the carriage of the neck massager, in this way, the neck massager also can be used everywhere without an external power supply.

Figure 10:
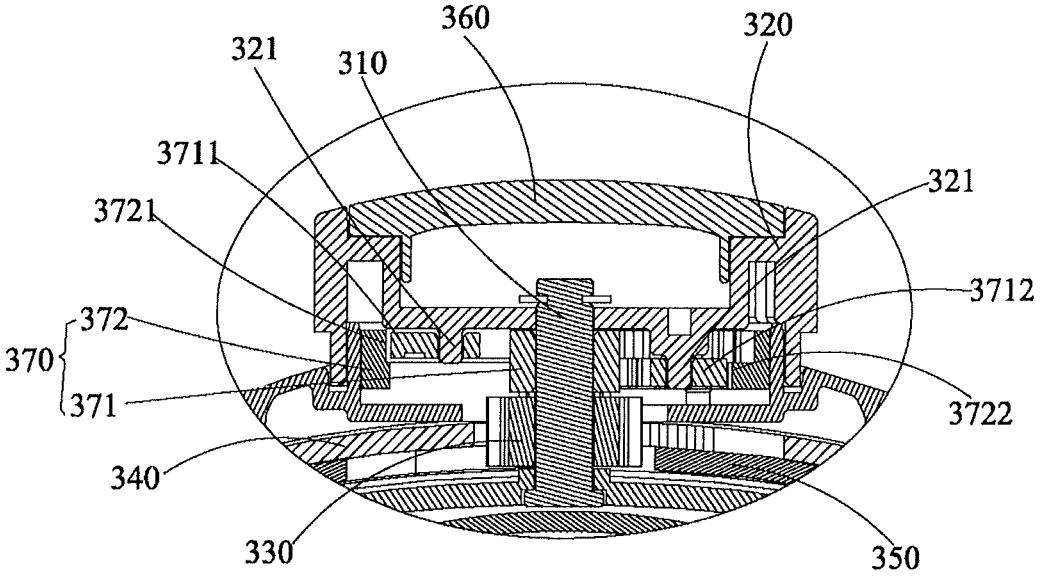
FIG. 10 is an enlarged view of a part labeled by C in FIG. 6.
Figure 11:
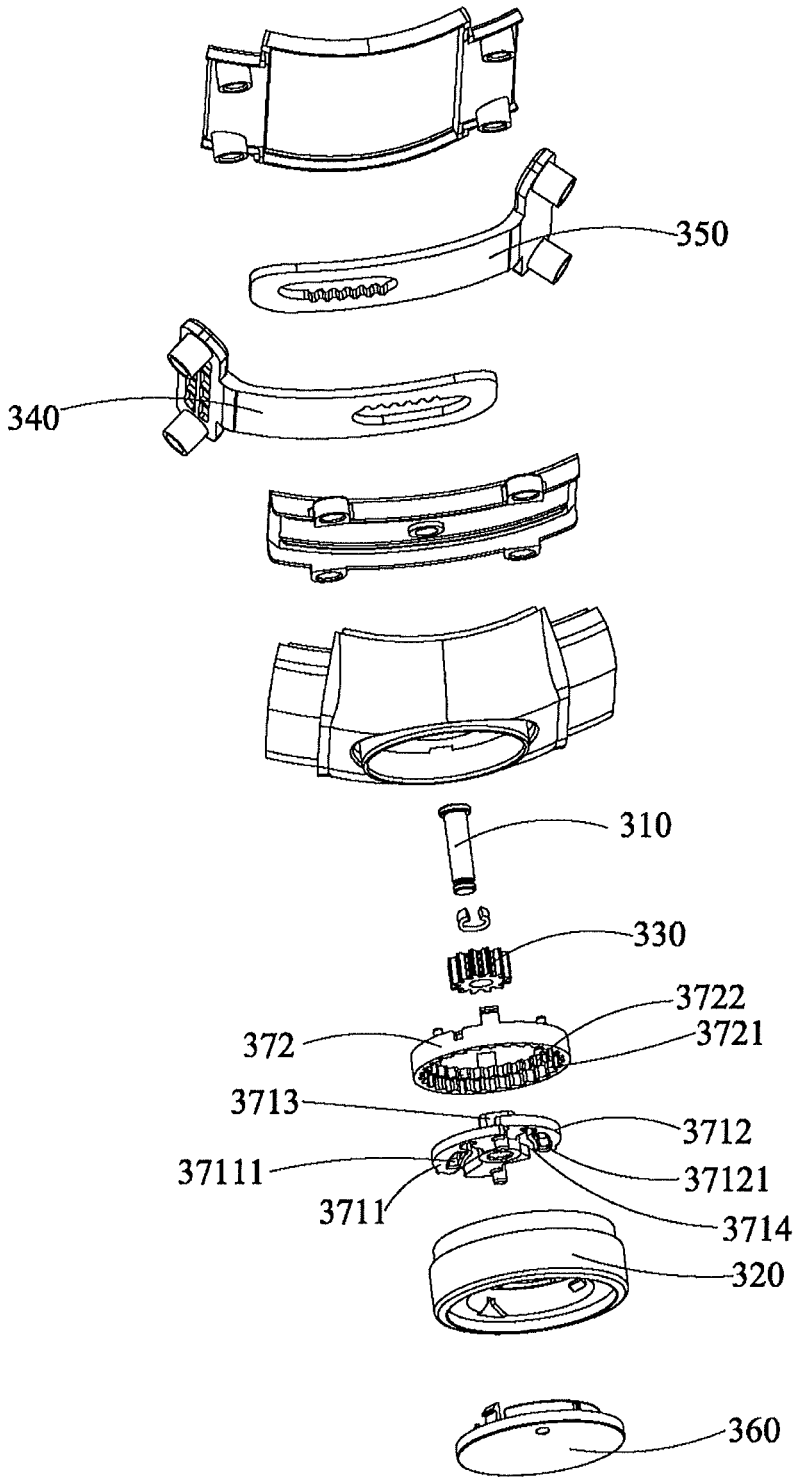
FIG. 11 is an exploded view of an adjusting means of the embodiment.

Referring to FIG. 6 and FIG. 10, the adjusting means 300 includes a rotating shaft 310 extending into the U-shaped neck pillow 100 from the external thereof, a knob 320 mounted on the external end of the rotating shaft 310, a gear 330 mounted on the internal end of the rotating shaft 310, a first rack 340 and a second rack 350 respectively engaging with the upper and lower of the gear 330, a knob cover 360 is provided by inserting in the outside of the knob 320, the first rack 340 and the second rack 350 are respectively connected to the shell 250 of the massage components correspondingly. When the knob 320 is rotated, the rotating shaft 310 is driven to rotate by the knob 320, the gear 330 mounted on the inner end of the rotating shaft 310 is driven to synchronously rotate by the rotating shaft 310, when the gear 330 is driven to rotate counterclockwise or clockwise, the first rack 340 and the second rack 350 respectively engaging with the upper and the lower of the gear 330 is driven to rotate close to or away from each other, since the first rack 340 and the second rack 350 respectively connect with the shell 250 of the two massage components 200, the two massage components 200 is driven to rotate close to or away from each other by the first rack 340 and the second rack 350 in order to get an appropriate spacing, which is convenient for the use of the different users. Of course, the adjusting of the spacing between the two massage components 200 is not limited by the above-mentioned structure, an overlapping means and using the corresponding active buckle of the overlapping means, for example, also can be used to adjust the space.

In this embodiment the adjusting means further has a bidirectional locking structure 370 between the knob 320 and the rotating shaft 310, the knob 320 and the rotating shaft 310 can be locked by the bidirectional locking structure 370. When the two massage components 200 are adjusted to an appropriate distance by the knob 320, the knob 320 is locked by the bidirectional locking structure 370, so that the knob can't be rotated by non-human rotation, the spacing between the two massage components 200, the displacement between the two massage components 200 can be avoided, which is convenient for users.

In particular, referring to FIG. 10, the locking structure 370 includes a ratchet wheel clasp 371 and a ratchet wheel base 372 engaging with the ratchet wheel clasp 371, the rotating shaft 310 is through fixed in the center of the ratchet wheel clasp 371, the bottom of the knob 320 has a connecting post 321 protruding from the bottom of the knob 320, the connecting post 321 is able to insert into the ratchet wheel clasp 371, when the knob is rotating, the ratchet wheel clasp 371 can be driven to synchronously rotate around the rotating shaft 310.

In this embodiment, the ratchet wheel clasp 371 has an upper ratchet buckle 3711 and a lower ratchet buckle 3712 mounted against each other, the ratchet wheel base 372 is provided with an upper ratchet ring 3721 and a lower ratchet ring 3722, wherein the ratchet directions of the upper ratchet ring 3721 and the lower ratchet ring 3722 are in the opposite direction, the ratchet buckle 3711 and the lower ratchet buckle 3712 respectively matches with the upper ratchet ring 3721 and lower ratchet ring 3722. When the knob 320 stops its rotation, the ratchet buckle 3711 and the lower ratchet buckle 3712 respectively engage with the upper ratchet ring 3721 and lower ratchet ring 3722, in this way, the ratchet wheel clasp 371 can't be rotated without external forces, the rotating shaft 310 can't be rotated, so does the gear 330, which can ensure that the first rack 340 is fixed relating to the second rack 350.

Figure 12:
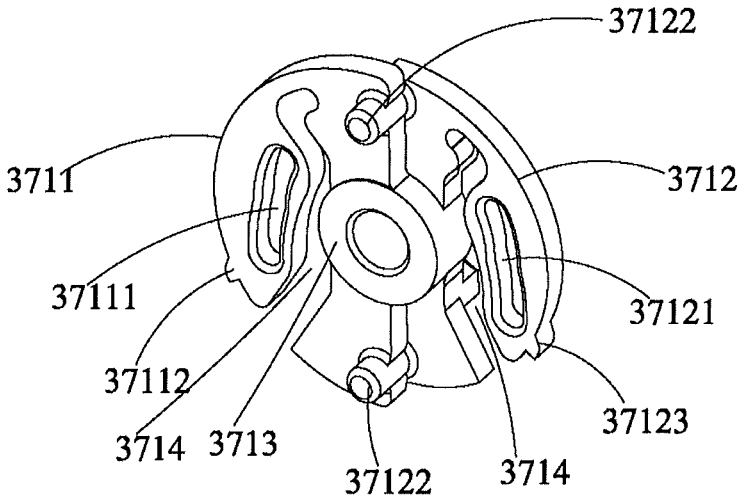
FIG. 12 is a schematic structure view of a ratchet wheel clasp of the embodiment.

In particular, referring to FIG. 12, the ratchet wheel clasp 371 includes a body 3713, the upper ratchet buckle 3711 and the lower ratchet buckle 3712 are provided at different levels along an axial direction of the body 3713, the upper ratchet buckle 3711 and the lower ratchet buckle 3712 are semicircle which symmetrically locates along a radial axis of the body 3713. The upper ratchet buckle 3711 and the lower ratchet buckle 3712 are provided symmetrically with first installation grooves 37111, 37121, the two first installation grooves 37111, 37121 are located at the same circle. The inside of the knob 320 has two symmetrical connecting posts 321, during installation the two connecting posts 321 are respectively located in the two first installation grooves 37111, 37121. For the matching of the first installation grooves 37111, 37121 and the connecting posts 321, the ratchet wheel clasp 371 and ratchet wheel base 372 can be driven to disengage effectively.

Particularly, in the radial axis the lower ratchet buckle 3712 has two second fixing posts 37122, the two fixing posts 37122 resist against the edges of the upper ratchet buckle 3711. The inside of the knob 320 has two second installation grooves (not shown), during installation the two fixing posts 37122 respectively are slidingly arranged in the two second installation grooves. For the matching of the second installation grooves and the fixing posts 37122, the ratchet wheel clasp 371 can be driven to rotate effectively with the rotation of the knob 320.

Referring to FIG. 12, there is a hollow gap 3714 between the upper ratchet buckle 3711 and the body 3713, there is also a hollow gap 3714 between the lower ratchet buckle 3712 and the body 3713, and the gap 3714 is curve-shaped. Advantageously, the upper ratchet buckle 3711 and the lower ratchet buckle 3712 can have better elasticity and can disengage from the ratchet wheel 372 more easily.

Figure 13:
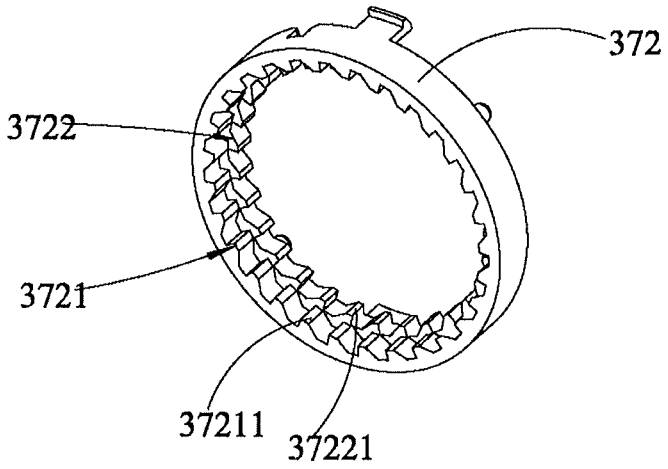
FIG. 13 is a schematic structure view of a ratchet wheel base of the embodiment.

Referring to FIG. 13, the ratchet wheel base 372 has a hollow shell-like structure, the outside of the inner hole of the shell-like structure has an upper ratchet ring 3721, the inside of the upper ratchet ring 3721 has a lower ratchet ring 3722, the left tooth surface of the upper ratchet 37211 of the upper ratchet ring 3721 is a right angle surface, the left tooth surface of the lower ratchet 37221 of the lower ratchet ring 3722 is a slope, the right tooth surface is a right angle surface. Referring to the FIG. 12, the outside edge of the upper ratchet buckle 3711 has a first protrusion 37112, the outside edge of the lower ratchet buckle 3712 has a second protrusion 37123, the inside surface of the first protrusion 37112 extending in the peripheral direction of the ratchet wheel clasp 371 is a right angle surface, and the outside surface is a circle-arc surface. The inside surface of the second protrusion 37123 extending in the peripheral direction of the ratchet wheel clasp 371 is a right angle surface, and the outside surface is a circle-arc surface. When the outside of the ratchet wheel clasp 371 is sheathed with the ratchet wheel base 372, the right angle surface of the first protrusion 37112 engages with the left tooth surface of the upper ratchet 37211 of the upper ratchet ring 3721, and the right angle surface of the second protrusion 37123 engages with the right tooth surface of the lower ratchet 37221 of the lower ratchet ring 3722.

When the knob 320 is turned counterclockwise, the ratchet wheel clasp 371 is driven by the two fixing posts 37122 to rotate with the rotation of the knob 320, the two connecting posts 321 fixed inside of the knob 320 rotates counterclockwise during the rotation of the knob 320, wherein the connecting post 321 in the first installation slot 37121 moves upwards, the connecting post 321 in the first installation slot 37111 moves downwards, the engaging surface of the upper ratchet buckle 3711 of the ratchet wheel clasp 371 and the upper ratchet ring 3721 of the ratchet wheel base 372 is on the left side of the upper ratchet 37211, in this way, the ratchet buckle 3711 disengages from the upper ratchet 37211 of the upper ratchet ring 3721 under the pull of the two connecting posts 321, the circle-arc surface of the second protrusion 37123 of the lower ratchet buckle 3712 disengages from the slope of the lower ratchet 37221 of the lower ratchet ring 3722 after a smooth transition during the clockwise rotation of the lower ratchet buckle 3712. Thus the ratchet wheel clasp 371 can move without the limitation of the ratchet wheel base 372, the gear 330 can be driven to move counterclockwise, the first rack 340 and the second rack 350 engaging with the upper and the lower of the gear 330 move towards each other, so that the shell 250 of the two massage components 200 can contract inwards, which is appropriate for different users. Similarly, when the knob 320 stops its' rotation, the rotary first protrusion 37112 and second protrusion 37123 also stop their rotation and are located on the upper ratchet 37211 and the lower ratchet 37221, the ratchet wheel clasp 371 can't rotate without external forces, and the gear 330 also can't rotate. Advantageously, the first rack 340 and the second rack 350 can't move inwards or outwards. When the knob 320 is clockwise turned, the two massage components 200 are driven to go away from each other, the principle is the same with the above description which isn't detailed again.

In this present embodiment, both of two ends of the U-shaped neck pillow 100 further include belts 110 defining through holes 111 which can be used as holders in use, the shape of the through holes 111 is similar to the hand under a bending hold state. When the neck massager is used, the hands can access and hold the through holes 111 and the U-shaped neck pillow 100 can be grasped firmly. Advantageously, the U-shaped neck pillow 100 is grasped firmly, on the one hand, the massage heads located the inside of the U-shaped neck pillow 100 can be ensured to keep close contact with the neck and massage the neck, on the other hand, due to the assist of human hands the U-shaped neck pillow 100 is protected from slipping from the neck during vibration massage.

The present invention has been further detailed in the above descriptions with reference to the preferred embodiments; however, it shall not be construed that implementations of the present invention are only limited to these descriptions. Many simple deductions or replacements may further be made by those of ordinary skill in the art without departing from the conception of the present invention, and all of the deductions or replacements shall be considered to be covered within the protection scope of the present invention.

The invention claimed is:

1. A neck massager, comprising:

a U-shaped neck pillow capable of being hung on a neck of a person, an inside of the U-shaped neck pillow corresponding to the neck and having two massage components, wherein the two massage components comprise:

an upper and a lower massage head arranged from a top downward in a direction perpendicular to a longitudinally extending direction of the U-shaped neck pillow along the inside of the U-shaped neck pillow, and a height of the upper massage head being lower than that of the lower massage head, wherein an adjusting mechanism for adjusting a distance between the two massage components is arranged between the two massage components, the adjusting mechanism comprising:

a rotating shaft, a knob, and a bidirectional locking structure between the knob and the rotating shaft, the locking structure comprising:

a ratchet wheel clasp synchronously rotatable with the knob and a ratchet wheel base engageable with the ratchet wheel clasp, the rotating shaft being fixed in a center of the ratchet wheel clasp, wherein the ratchet wheel clasp has an upper ratchet buckle and a lower ratchet buckle mounted against each other, the ratchet wheel base includes an upper ratchet ring and a lower ratchet ring, the ratchet directions of the upper ratchet ring and the lower ratchet ring being in an opposite direction, the upper ratchet buckle and the lower ratchet buckle respectively matching with the upper ratchet ring and the lower ratchet ring.

2. The neck massager of claim 1, wherein the two massage components are provided in the inside of the U-shaped neck pillow corresponding to the neck, the rotating shaft extending into the U-shaped neck pillow from an external part thereof, the knob being mounted on an external end of the rotating shaft, the adjusting mechanism further comprising:

a gear mounted on an internal end of the rotating shaft, and two racks respectively engaging with upper and lower portions of the gear, the two racks being respectively connected to the massage components correspondingly.

3. The neck massager of claim 2, wherein each of the two massage components further comprise:

a driving mechanism for driving the upper and lower massage heads, and a transmission mechanism mounted between the driving mechanism and the upper and lower massage heads, wherein the transmission mechanism is located in a shell, and the upper and lower massage heads protrude towards the inside of the U-shaped neck pillow.

4. The neck massager of claim 3, wherein the transmission mechanism comprises a driving gear, a first follower gear driven by the driving gear, and two second follower gears driven by the first follower gear and respectively used for driving the upper and lower massage heads of each of the massage components, and the driving mechanism has a power element whose output shaft extends into the shell, the driving gear being fixed on the output shaft.

5. The neck massager of claim 4, wherein a third follower gear is provided between the first follower gear and the two second follower gears, both of the first follower gear and third follower gear are duplicate gears having an upper gear ring and a lower gear ring, the upper gear ring of the first follower gear engages with the lower gear ring of the third follower gear, the lower gear ring of the first follower gear engages with the driving gear, the upper gear ring of the third follower gear respectively engages with the two second follower gears.

6. The neck massager of claim 4, wherein the driving mechanism further comprises a control PCB connected with the power element, the control PCB being connected with batteries in the U-shaped neck pillow.

* * * * *